United States Patent [19]

Kitchen

[11] 4,241,723

[45] Dec. 30, 1980

[54] PULSE COMBUSTION APPARATUS

[76] Inventor: John A. Kitchen, R.R. 3, Hastings, Canada, K0L 1YO

[21] Appl. No.: 960,975

[22] Filed: Nov. 15, 1978

[51] Int. Cl.[3] ..... A61M 27/00

[52] U.S. Cl. ..... 126/350 R; 431/1; 122/24; 60/39.8

[58] Field of Search ..... 431/1, 115; 122/24; 126/350 R; 60/39.8

[56] References Cited

U.S. PATENT DOCUMENTS

| | | | |
|---|---|---|---|
| 2,965,079 | 12/1960 | Collinson | 122/24 |
| 3,192,986 | 7/1965 | Haag | 431/1 |
| 3,202,198 | 8/1965 | Haag et al. | 122/24 X |
| 3,267,985 | 8/1966 | Kitchen | 431/1 |
| 3,606,867 | 9/1971 | Briffa | 122/24 |
| 3,819,318 | 6/1974 | Pearson | 431/1 |
| 3,853,453 | 12/1974 | Olsson | 60/39.8 |

*Primary Examiner*—George T. Hall
*Attorney, Agent, or Firm*—Robers, Bereskin & Parr

[57] ABSTRACT

A pulse combustion heater is described and includes a combustion chamber and at least one exhaust pipe forming a resonant system with a chamber. In one aspect of the invention, the combustion chamber has an internal cavity of flattened spherical shape which causes combustion gases returning to the combustion chamber to flow into said cavity in a double toroidal flow pattern. In another aspect, the apparatus has an exhaust system which includes a primary exhaust pipe of a length selected so that combustion of gases is at least substantially complete before the gases leave the pipe. The pipe terminates at a manifold to which is connected a plurality of heat exchange coils of helical shape from which heat is transferred to a fluid circulated around the coils.

17 Claims, 10 Drawing Figures

PULSE COMBUSTION APPARATUS

This invention relates to pulse combustion apparatus and to heaters of the pulse combustion type.

A pulse combustion apparatus conventionally includes a combustion chamber and an exhaust pipe which forms a resonant system with the combustion chamber. At each cycle of the apparatus, a fuel charge is admitted to the combustion chamber and is ignited. The charge expands into the exhaust pipe causing a partial vacuum transient in the combustion chamber which both assists in drawing in a fresh charge, and causes high temperature gas to be drawn back into the combustion chamber from the exhaust pipe. The fresh fuel charge spontaneously ignites, establishing the next cycle and the apparatus is self-sustaining after initial ignition. In a heater of the pulse combustion type, a fluid to be heated is brought into heat exchange relationship with the exhaust pipe.

My U.S. Pat. No. 3,267,985 discloses a pulse-combustion-type heater in which the combustion chamber has substantially the shape of two conical shells joined together at their major diameters along a common line of juncture. Five exhaust pipes are coupled to the combustion chamber for heating and are disposed in a chamber through which water is circulated. While this form of combustion chamber and exhaust system has been found to provide a very stable combustion cycle, the present invention is aimed at providing further improvements intended to enhance performance.

According to one aspect of the invention a pulse combustion apparatus is provided and includes a combustion chamber, at least one exhaust pipe forming a resonant system with the combustion chamber, means for admitting successive fuel charges to said chamber, and ignition means operable to initiate combustion in the chamber. The combustion chamber has an internal cavity of a shape which extends about a median plane, which is circular in said plane, and which curves generally inwardly from both sides of said plane around its entire periphery, towards first and second ends of the cavity. An inlet is provided at one of said ends, through which successive fuel charges can enter the combustion chamber from said fuel charge admitting means in a direction generally normal to said median plane of the combustion chamber. The combustion chamber also includes an exhaust gas outlet disposed in said median plane. The exhaust pipe is coupled to said exhaust gas outlet and extends from the combustion chamber generally tangentially with respect to said cavity. As a result of the combustion chamber shape and the arrangement of the exhaust pipe, combustion gases returning to said combustion chamber under the effect of a vacuum transient in the chamber are caused to flow into said cavity in a double toroidal flow pattern into which a subsequent fuel charge enters generally centrally from said combustion chamber inlet.

According to another aspect of the invention, a pulse combustion heater is provided and includes a housing, a combustion chamber disposed within the housing and having an inlet and an outlet, means for admitting successive fuel charges to said chamber through said inlet, ignition means operable to initiate combustion in said chamber, and an exhaust system coupled to the combustion chamber and forming a resonant system therewith. The exhaust system includes a primary exhaust pipe having first and second ends and coupled to the combustion chamber at its first end so as to extend generally tangentially from the combustion chamber.

The primary exhaust pipe is of a length selected so that combustin is at least substantially complete before combustion gases leave said pipe in use. The exhaust system also includes a manifold having an inlet to which the second end of the primary exhaust pipe is coupled and a plurality of outlets spaced around the manifold. A corresponding plurality of heat exchange coils are provided and each coil is in the form of a hollow tube shaped to define a helix of substantially constant diameter extending about a longitudinal axis and having an inlet coupled to one of said manifold outlets, and an outlet. The coils are arranged around said manifold with their longitudinal axes generally parallel to one another. A heat exchange chamber is provided in said housing and contains said heat exchange coils. The chamber has an inlet and an outlet for a fluid to be heated. An exhaust chamber is also provided in the housing and has a plurality of inlets to which the outlets of said heat exchange coils are coupled, and an outlet for exhaust gases.

In order that the invention may be more clearly understood, reference will now be made to the accompanying drawings which illustrate a number of preferred embodiments of the invention by way of example, and in which.

Figure 1:
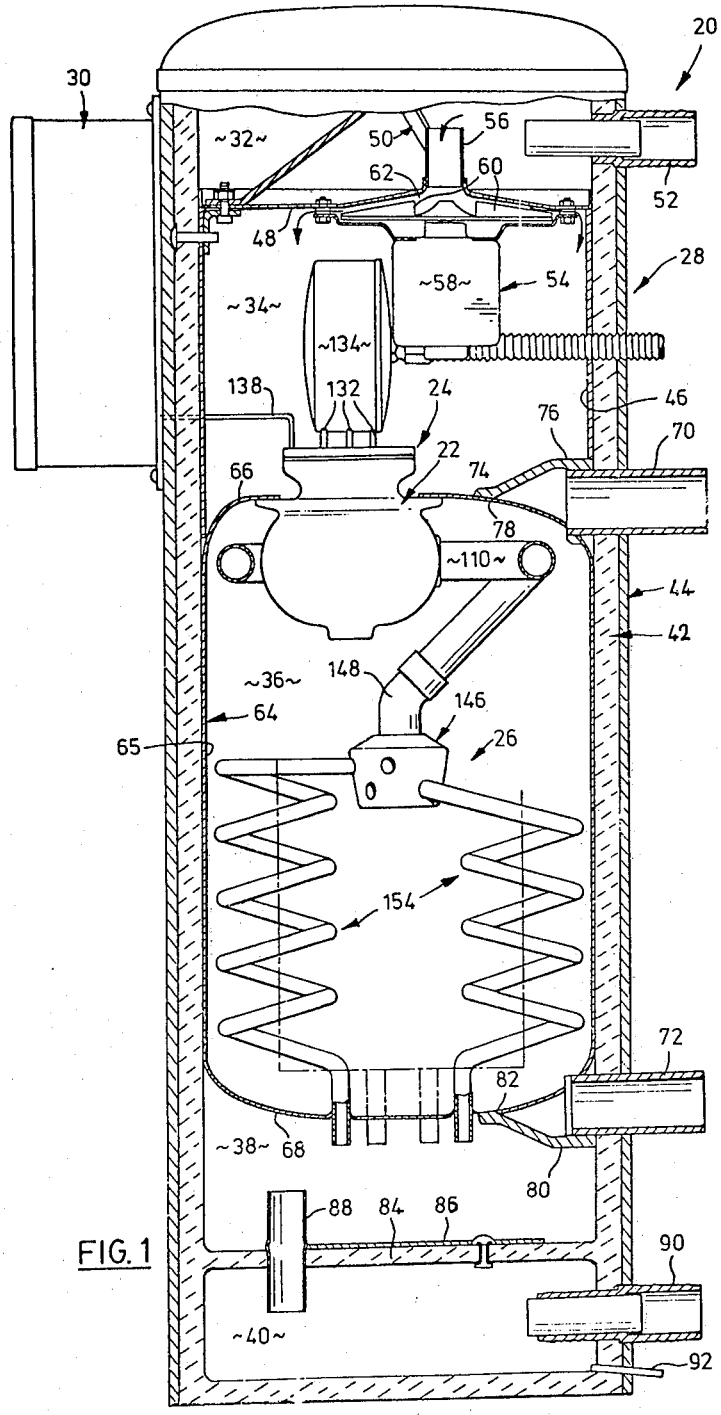
FIG. 1 is a vertical sectional view through a pulse combustion heater according to the invention.

Referring first to FIG. 1, a pulse combustion heater is generally indicated at 20 and includes a combustion chamber 22, valve means 24 at the top of the chamber for admitting fuel charges thereto, and an exhaust system 26. The components of the apparatus are disposed within a housing 28 which is designed to be self-standing on a suitable support surface. Reference numeral 30 indicates a control box at one side of the housing; however, since the control equipment forms no part of the present invention, it will not be described in detail. For present purposes it is sufficient to note that the control equipment includes an ignition transformer connected by a high tension lead (not shown) to a spark plug in the combustion chamber. The spark plug is used for starting only.

Housing 28 is divided internally as will be described to define, from top to bottom, an air inlet chamber 32, an air cushion chamber 34, a heat exchange chamber 36, a muffler chamber 38 and an exhaust chamber 40. The housing is defined by inner and outer casings denoted 42 and 44 respectively. The inner casing is made of high strength concrete, while the outer casing is made of steel. At the position of the air cushion chamber 34, the inner casing is fitted with a liner 46 of galvanized steel. The top of chamber 34 is defined by a plate 48 which separates the air cushion chamber 34 from the air inlet chamber 32. Supporting structure above plate 48 is generally indicated at 50 but will not be described in detail. Also, it should be noted that suitable sound insulating material is incorporated in the top of the housing and in the inner casing, but has not been shown, again because it forms no part of the invention.

Air inlet chamber 32 communicates with the exterior of the housing by way of an air inlet 52 which extends through the inner and outer casing. This allows ambient air or air from a supply pipe to be drawn into the housing for combustion as required. A fan unit generally denoted 54 is suspended below plate 48 and has an inlet 56 within chamber 32. The fan unit includes an electric motor 58 driving fan blades 60 arranged within a fan chamber 62 which discharges into the air cushion chamber 34. This chamber provides a reservoir of combustion air. Air is drawn from chamber 34 into the combustion chamber 22 as required under the control of the valve means generally indicated at 24. Fan unit 54 is used only for starting; after ignition, the combustion process is self-aspirating.

Heat exchange chamber 36 is defined by a liner assembly generally denoted 64, which, in effect, forms a boiler inside housing 28. Thus, it will be seen that the liner assembly includes a cylindrical portion 65 and top and bottom closures or "heads" 66 and 68 respectively at opposite ends of the heat exchange chamber and that the chamber is provided with an inlet 70 and an outlet 72 which extend through housing 28. Each of these components is in the form of a tubular sleeve which passes through the housing 28 and communicates with an associated pipe connection which mates with a corresponding opening in the relevant closure member of liner assembly 64. In FIG. 1, the pipe connection associated with inlet 70 is denoted 76 and the associated opening in the top closure 66 is indicated at 78. The corresponding pipe connection for outlet 72 is denoted 80 and the corresponding opening is indicated at 82. The inlet and outlets are coupled to external equipment (not shown) for circulating water through a heat exchange chamber 36 for heating. The combustion chamber 22 is mounted in an opening 74 in the top closure 66 of the liner assembly 64 so that water entering the heat exchange chamber 36 through inlet 70 will flow around the combustion chamber for transfer of heat from the chamber to the water. Similarly, as the water flows down in chamber 36 towards outlet 72, it will flow around the exhaust system 26 and receive heat therefrom.

Muffler chamber 38 is defined between the lower closure member 68 of liner assembly 64 and a plate 84 which extends transversely inside housing 28 at a spacing below the bottom closure member 68. The exhaust system 26 discharges generally vertically downwards into chamber 38 as will be described and a heat shield 86 is attached to the upper surfaces of plate 84. A muffler tube 88 extends generally vertically through plate 84 at a position spaced laterally from the position at which the exhaust system discharges into chamber 38. Thus, exhaust gases entering chamber 38 from the exhaust system 26 will pass into exhaust chamber 40 by way of muffler pipe 88. Chamber 40 has an exhaust outlet pipe 90 through which the exhaust gases leave housing 28 and from which the gases may be vented to atmosphere or otherwise disposed of as appropriate. A narrow condensate drain tube 92 is provided at the bottom of chamber 40 and is inclined downwardly so that any liquid which may collect in the chamber will drain to the outside.

Figure 2:
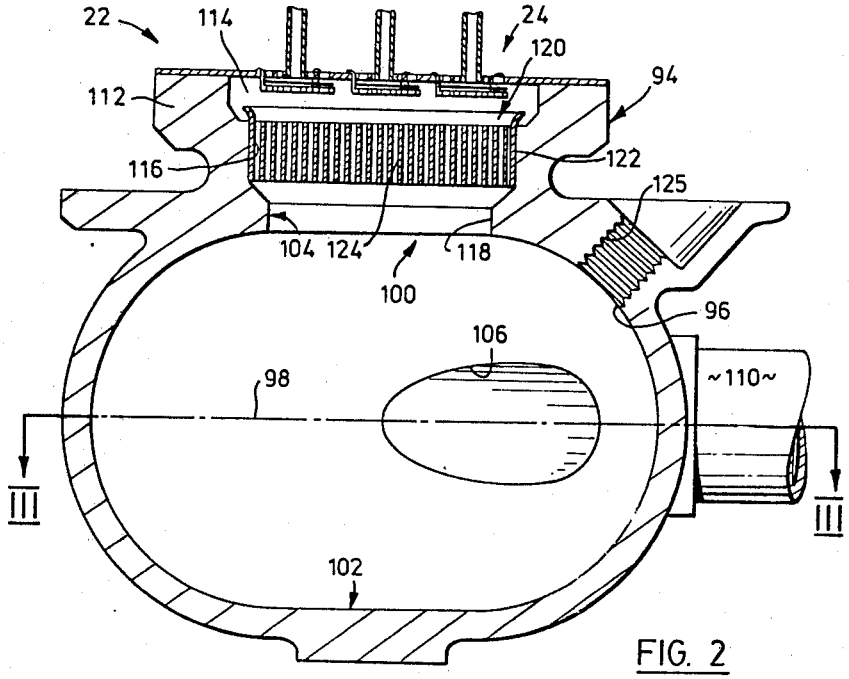
FIG. 2 is a vertical sectional view through the combustion chamber of the apparatus shown in FIG. 1.
Figure 3:
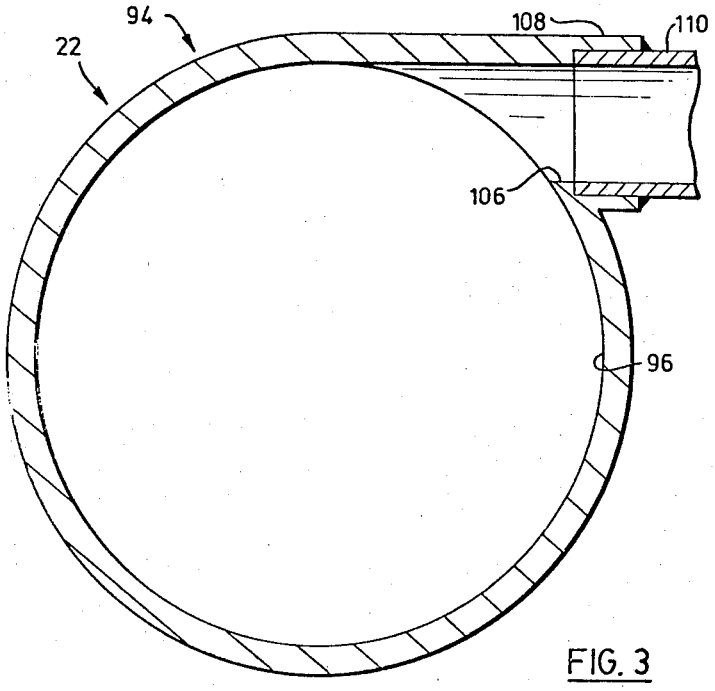
FIG. 3 is a transverse sectional view on line III—III of FIG. 2.

Reference will now be made to FIG. 2 and 3 in describing the combustion chamber 22 of the apparatus. Combustion chamber 22 is in the form of a one-piece bronze casting, denoted 94, at the top of which the valve means 24 is located. The combustion chamber has an internal cavity 96 which is generally of flattened spherical shape. Thus, cavity 96 extends about a median plane 98, on which plane section III—III is taken. The cavity is of a shape which is circular in said plane, and which curves generally inwardly from both sides of said plane around its entire periphery towards first and second ends 100 and 102 of said cavity. Casting 94 defines an inlet 104 at the first end of the cavity through which successive fuel charges can enter the combustion chamber cavity, while the second end 102 of the cavity is closed and generally flat. An exhaust outlet 106 is provided in the wall of the combustion chamber and is located in median plane 98. An integral sleeve 108 extends from the combustion chamber generally tangentially with respect to cavity 96 and a pipe 110 of the exhaust system (see later) is coupled to the sleeve.

The combustion chamber inlet 104 is in the form of a passageway which extends through casting 94 from a top flange 112 to cavity 96 and includes three portions 114, 116 and 118 of progressively reducing diameter considered in the direction of fuel charge flow. As will be seen from FIG. 4, the flange 112 and passageway portions 114, 116 and 118 are of circular shape in plan. The center passageway portion 116 receives a flame trap 120 for preventing blow-back of burning gases through the combustion chamber inlet. Flame trap 120 is in the form of an outer tubular retainer 122 and a core 124 formed of a spiral of corrugated stainless steel strip; the corrugations leave openings between the turns of the spiral through which fuel charges can flow. A screw threaded opening 125 adjacent inlet 104 receives a spark plug (not shown) for initiating the combustion process.

Figures 4, 5:
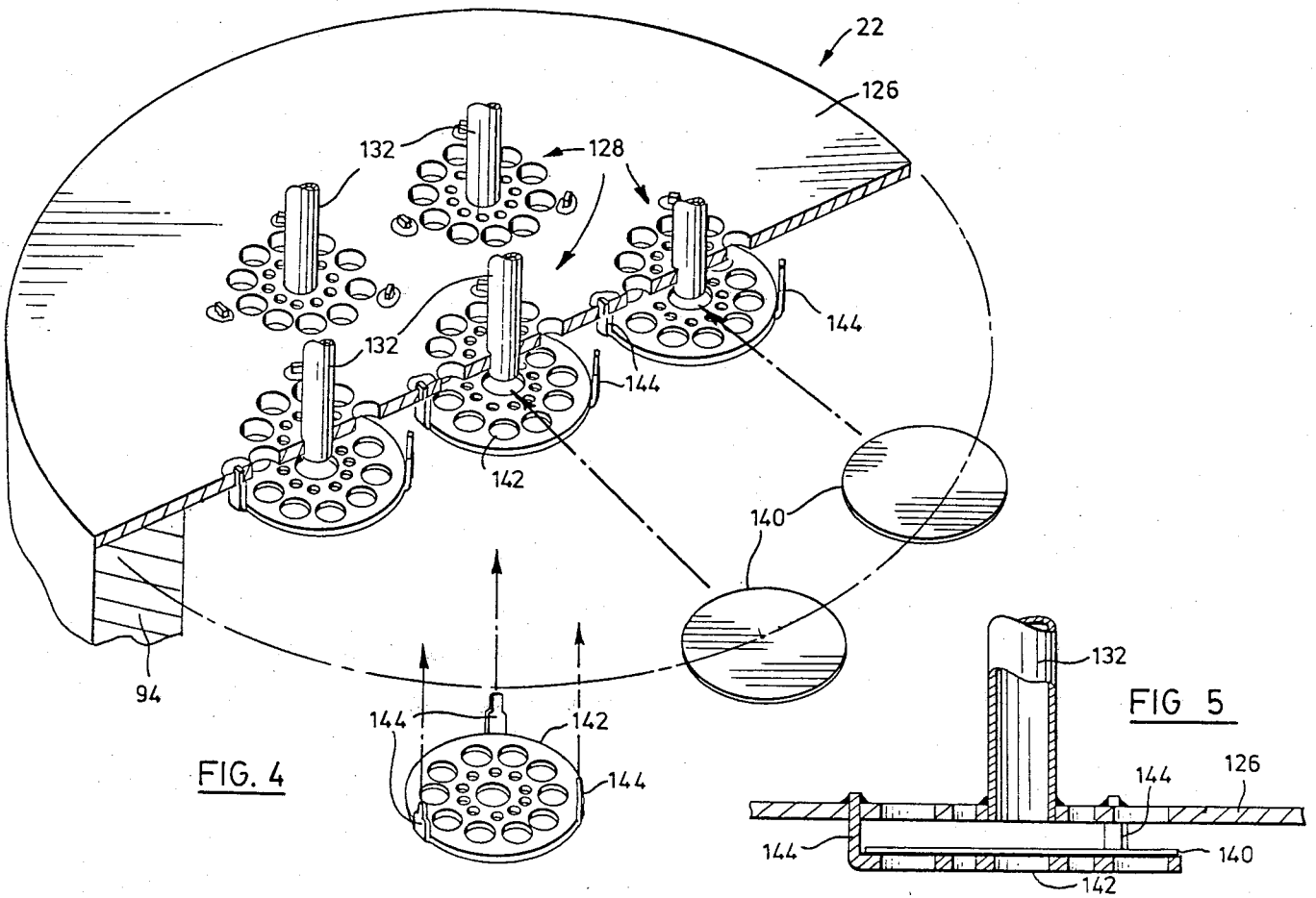
FIG. 4 is a perspective view, partly in section and partly exploded, showing the valve means of the combustion chamber of FIGS. 2 and 3.
FIG. 5 is a vertical sectional view of part of FIG. 4.

Referring now more particularly to FIGS. 4 and 5, valve means 24 includes a valve plate 126 mounted on the top surface of the flange 112 of casting 94. Plate 126 is provided with a number of sets of openings for admitting fuel charges of air and natural gas to the combustion chamber. In FIG. 4, the sets of openings are denoted by reference numeral 128 and it will be seen that five such sets are visible; in fact, plate 126 is provided with seven sets of valve openings although two of the sets do not appear in FIG. 4. Each set of openings includes a central opening 130 for admitting natural gas and a plurality of openings 131 distributed around opening 130 and through which air is admitted to the combustion chamber. Each central opening 130 is fitted with an inlet tube 132 which extends vertically upwardly from plate 126. Referring back to FIG. 1 the tubes 132 communicate with a gas cushion chamber defined by a casing 134 which in this case is made of sheet brass. The gas cushion chamber is of generally cylindrical shape with domed ends (although the particular shape is not critical) and is fitted at one end with a corrugated fuel inlet tube 136 which extends through housing 28 and communicates outside the housing with a source of natural gas (not shown). Thus, the gas cushion chamber 134 will provide the combustion chamber with what is, in effect, a reservoir of gas at source pressure for admission to the chamber through the fuel inlet tubes 132. Air cushion chamber 34 provides a similar reservoir of combustion air. A pressure sensing tube 138 is shown adjacent the air cushion chamber 134 in FIG. 1 and can be connected to switch in control box 30 for indicating when combustion has been established. Means (not shown) may also be provided for maintaining a substantially constant air/fuel ratio as described in my U.S. Pat. No. 3,267,985.

Referring back to FIGS. 4 and 5, the sets 128 of openings in plate 126 are controlled by individual valves, each of which includes a light and freely movable valve disc such as those shown in exploded positions at 140 in FIG. 4. In this particular embodiment, the discs are made of Dacron (T.M.) fabric coated with polychlorotrifluoroethylene sold under the trade mark Kel-F by M. W. Kellog Co. Each disc 140 is retained below the associated set of openings by a support plate 142 suspended from valve plate 126. Each support plate 142 is of circular shape and is formed with a set of openings corresponding generally to the openings in plate 126. Three integral lugs 144 project upwardly from plate 142 for suspending the plate. The lugs extend through opening in plate 126 and are bent over and sealed by silver brazing as can best be seen in FIG. 5. Thus, it will be appreciated that each valve disc 140 is supported by the associated plate 142 and is trapped against lateral movement by lugs 144. The openings in plate 142 permit pressure waves from the combustion chamber to force the valve disc 140 upwardly to close off the associated openings in valve plate 126. When the pressure decreases, the discs will move down and admit fuel to the combustion chamber.

Figure 6:
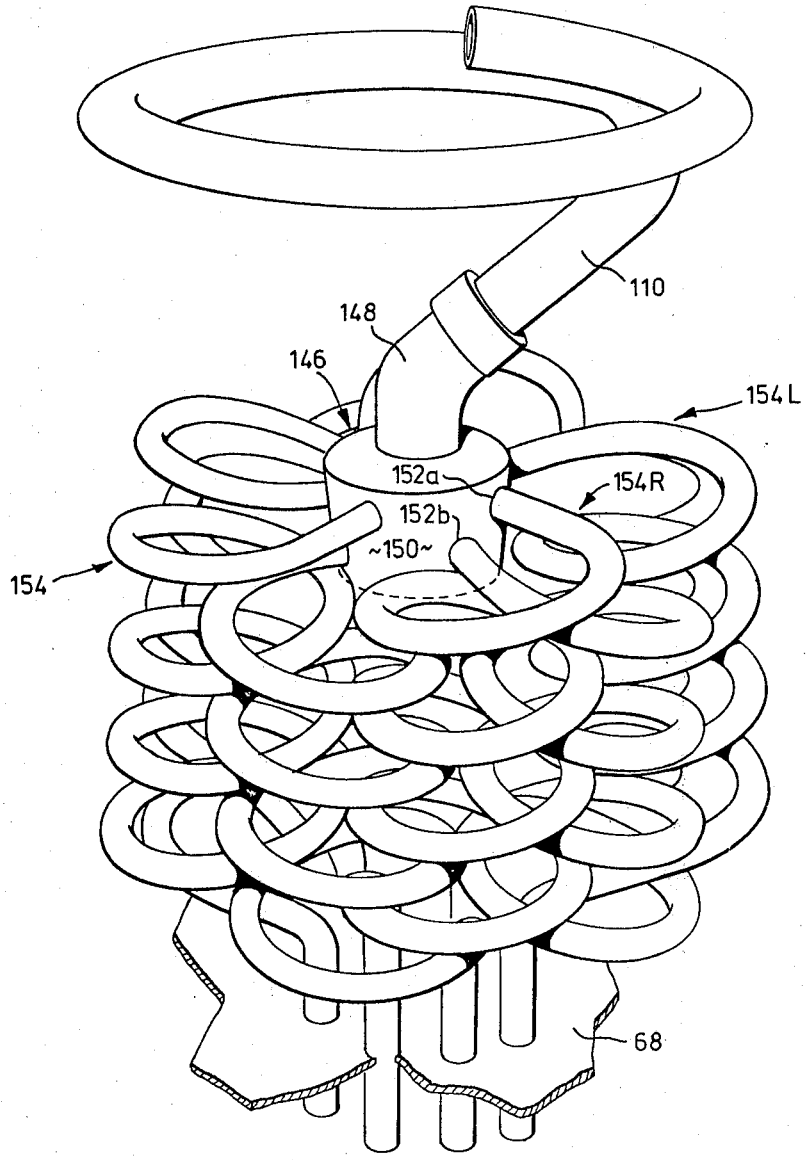
FIG. 6 is a perspective view of the exhaust system of the apparatus of FIG. 1.
Figure 7:
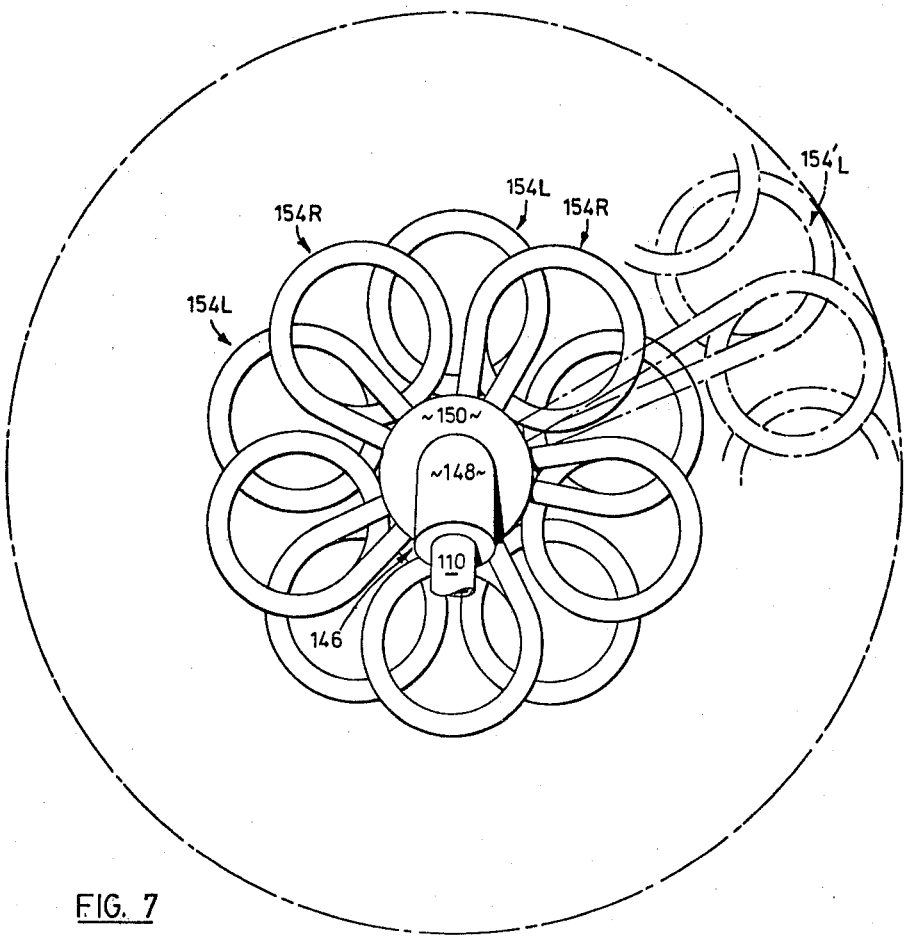
FIG. 7 is a plan view corresponding to FIG. 6.

FIGS. 6 and 7 show the exhaust system of the heater and will now be more particularly described. The system includes a single primary exhaust pipe 110 part of which is visible in FIGS. 3 and 4. This primary exhaust pipe has an inlet end coupled to the combustion chamber so as to extend outwardly from the chamber tangentially with respect ot its circular configuration. Pipe 110 is of relatively substantial length (see later) and is shaped to define a generally circular loop portion which extends around the combustion chamber (see FIG. 1), and an end portion which is bent downwardly and connected to a manifold 146. Manifold 146 has a single central inlet to which the primary exhaust pipe 110 is coupled. In this embodiment the inlet is defined by a sleeve 148 which projects upwardly from a main body portion 150 of the manifold and which is angled to correspond with the inclination of outlet end portion of the primary exhaust pipe 110. Pipe 110 is received in and welded to sleeve 148. The body portion 150 of the manifold 146 is generally cylindrical in shape and is formed with a plurality of outlets in the form of openings in its outer surface which communicate with the single central inlet. The outlet openings are arranged in pairs in equally spaced relationship around the body portion 150 of manifold 146 with the outlets in each pair spaced vertically from one another and staggered laterally to a slight extent as can clearly be seen in FIG. 6 in the case of one pair of outlet openings (denoted **152*a* and 152*b*). A plurality of heat exchange coils generally denoted 154 are provided for connecting manifold 146 with the muffler chamber 38 (FIG. 1). Each coil is in the form of a hollow tube shaped to define a helix of substantially constant diameter extending about a longitudinal axis and having an inlet coupled to one of said manifold outlets, and an outlet which communicates with the muffler chamber 38 of the heater. The heat exchange coils are arranged in pairs around manifold 146 and each pair comprises one left hand wound coil and one right hand wound coil of identical shape and size. Referring to FIG. 6, reference numeral 154L denotes the left hand coil of a pair while 154R denotes the corresponding right hand coil. The corresponding pair of coils are similarly designated in FIG. 7. Five such pairs of coils are provided around manifold 146**.

It will be apparent from FIGS. 6 and 7 that, by virtue of the vertically staggered arrangement of the manifold outlets **152*a* and 152*b*** the coils in each pair can "mesh" with or be interleaved with one another so that the turns of one coil fit between the turns of the corresponding coil. Similarly, adjacent coils of different pairs can be meshed or interleaved with one another. This provides for a very compact heat exchange unit having large capacity. A further advantage of this arrangement is that it can be readily fabricated using conventional coil winding equipment and with minimum bending of the pipes. Thus, successive coiled sections can be taken directly from a coil winding machine and fitted into the manifold without the need for special fabrication techniques.

A still further advantage of this heat exchanger construction is that heat exchangers having even more coils can be readily fabricated by enlarging the manifold and adding coils around the periphery of the existing coils are indicated in chain dotted line at 154' in FIG. 7. These additional coils may be arranged in pairs of left and right hand coils interleaved with one another in the same fashion as the center coils. The inlet ends of the coils would be extended inwardly as shown in FIG. 7 and connected into the larger manifold in a second row of staggered manifold outlets above the outlets shown in FIG. 6.

A still further advantage of the heat exchange structure shown in the drawings derives from the fact that curved pipes are used. Thus, in a heat exchanger having straight pipes, the boundary layer effect produces, in effect, an insulating layer of stagnant air which tends to inhibit heat transfer from the pipes and reduces the efficiency of the heat exchanger. In the present application in which high velocity gas flows are encountered, the use of curved pipes minimized the boundary layer effect and increases the efficiency of the heat exchanger compared with a conventional unit having straight pipes. Curved pipes also have the advantage that they are capable of accommodating thermal expansion and contraction without the need for special precautions in the construction of the heat exchanger.

Referring back to FIG. 6, it will be seen that the outlet end portion of each of the heat exchange tubes is shaped to define an axially parallel end portion **154*a* which extends through the bottom boiler head 68 of the heat exchange liner assembly 64 (see FIG. 1**).

The operation of the heater will now be described initially with reference to FIG. 1 of the drawings. As indicated previously, the apparatus is designed to be self-sustaining after initial starting. Thus, a supply of fuel and air is delivered to the combustion chamber from the gas cushion chamber 134 and from the fan 54 respectively and is ignited by the spark plug in the combustion chamber. The pressure rise which occurs in the chamber upon ignition causes the valve discs 140 (FIG. 4) to be propelled upwardly and close off the air and gas inlet openings in the valve plate 126. The combustion gases expand and enter the primary exhaust pipe 110, causing a vacuum transient in the combustion chamber itself. This allows the valve discs 140 to move downwardly under the effect of the pressurized air and fuel acting on the discs from above so that a fresh fuel charge enters the combustion chamber. The vacuum transient also has the effect of causing combustion gases in the exhaust system to return to the combustion chamber.

Figure 8:
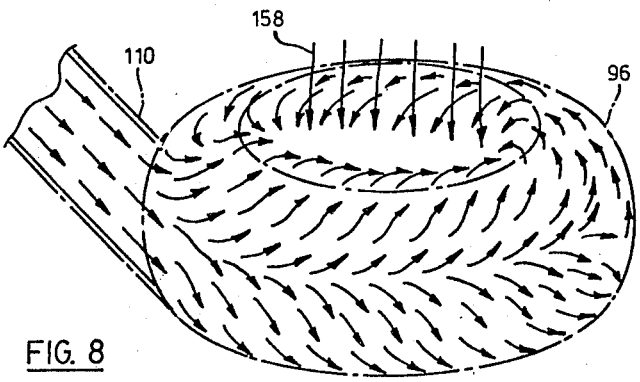
FIG. 8 is a diagrammatic illustration of the gas flow pattern in the combustion chamber of the apparatus shown in FIG. 1.

The combustion chamber has been designed so that this returning pressure wave of combustion gases entering the combustion chamber is caused to flow in a double toroidal flow pattern as indicated diagrammatically in FIG. 8. In that view, the wall of the combustion chamber cavity is indicated by a chain dotted outline denoted 96 and a tangential portion of the primary exhaust pipe is indicated at 110. By virtue of the tangential arrangement of this pipe and its position on the median plane of the combustion chamber cavity, the returning gases meet the combustion chamber wall generally in the region of the median plane. Since the wall curves inwardly at both sides of the plane, the gases are caused to flow inwardly both above and below the median plane in addition to being caused to follow the curvature of the wall around the circumference of the cavity. This generates the double toroidal flow pattern. Next the succeeding fuel charge enters the combustion chamber from inlet 104 generally centrally of the chamber and thus enters the center of the toroidal flow pattern of the combustion gases. In FIG. 8, the flow path of the fuel charge is indicated generally at 158.

It has been found that the flame in the combustion chamber is not extinguished at any time during the cycle of the apparatus. During the low pressure part of the cycle (that is during the vacuum transient—generally about one third to one half of the cycle time depending on cycle strength) the gases in the combustion chamber are relatively stagnant and a number of flame fronts persist throughout the mixture. This low pressure draws the next fuel charge into the center of the combustion chamber with very little turbulance. The combustion gases returning to the combustion chamber through the primary exhaust pipe 110 are delayed due to the length of the pipe, but enter the combustion chamber at a very high velocity. These gases may be well below ignition temperature (since the exhaust system is water cooled); however, while the temperature will have an effect on the operating frequency of the apparatus, it has not been found to cause instability in the combustion cycle. In any event, as these returning gases enter the combustion chamber the residual gases containing the flame fronts are rapidly mixed with the fresh charge due to the double toroidal flow pattern described above. There is a rapid increase of temperature and pressure and gases again start to flow out of the combustion chamber through the exhaust pipe. Complete ignition and pressure rise has been found to occur within approximately one tenth of the cycle time. This double toroidal turbulance pattern in the combustion chamber is very consistent with virtually no stray tails of flame which would cause pre-ignition of the charge and produce a pressure rise at the wrong time in the cycle. Thus, it will be understood that ignition of the incoming charge should be kept to a minimum until the high velocity combustion gases return to the combustion chamber. Ignition will then take place at a rate which is related to the gas velocity and the turbulance pattern.

An additional advantage derived from the combustion chamber design shown in the drawings is that the outside dimension of the combustion chamber can be minimized for a given volume, substantially reducing the space required to accommodate the combustion chamber. Another advantage is that the ratio of surface area to volume of the combustion chamber is at a minimum so as to reduce any quenching effect on the burning gases in the combustion chamber due to the presence of cooling water in the heat exchange chamber 36.

It has also been found that the design of the exhaust system has a significant impact on the operation of the apparatus. Thus, it will be noted that the system includes a primary exhaust pipe (110) which is of relatively large diameter and is of a significant length. These characteristics are selected with the aim of insuring that combustion is completed in the primary exhaust pipe 110 and is not carried through into the heat exchange portion of the exhaust system. Thus, it has been found that, even with the improved combustion chamber design provided by the invention, some combustion occurs in the exhaust system. The high velocity of the gases entering the exhaust system results in a high rate of heat transfer to the surrounding water which, with the temperature drop which occurs due to expansion, results in some carbon monoxide in the gases. By providing an exhaust system in which substantially all of the combustion takes place upstream from the heat exchange coils this cooling effect on the gases and hence the high carbon monoxide content of the exhaust is minimized, while at the same time achieving efficient heat exchange to the water in the heat exchange chamber 36 through the medium of the heat exchange coils 154. A thin layer of an insulating material may even be applied to the primary exhaust pipe 110 in an effort to maintain the temperature of the combustion gases in the pipe and thereby to reduce the carbon monoxide content of the gases. In practice, it has been found that an increase in surface temperature of even 100° F. will make a significant difference to the percentage of carbon monoxide in the exhaust.

A further expedient which may be adopted in the interest of minimizing carbon monoxide emission is to provide a restricter or nozzle (not shown) in the exhaust pipe at its connection to the combustion chamber. Thus, since the combustion cycle is dependent upon the high velocity of the gases returning to the combustion chamber during the low pressure part of the cycle for providing fast ignition, a restricter or nozzle provides for a larger volume for secondary combustion and at the same time gives the returning pressure wave a high velocity as it enters the combustion chamber (for rapid ignition). In practice, it has been found that, for optimum results, the inside diameter of the combustion chamber cavity in the median plane should be equal to or less than three times its height. Also, it has been found that the inside diameter of the primary exhaust pipe should be at least about $\frac{3}{4}$ of an inch and that the pipe should be not less than ten inches in length.

It has been found that a single pipe is suitable for an apparatus having a relatively small heat output rating and that, for a larger apparatus the number of pipes may be multiplied in proportion to the increase in output rating. For example, in practical tests, an apparatus rated at 100,000 B.t.u. per hour required a single pipe of 1" internal diameter and a 400,000 B.t.u. apparatus required four such pipes. In a multiple pipe installation they will be equally spaced around the combustion chamber and will each be disposed tangentially thereto. A more complex manifold (as manifold 146) is obviously required in such cases.

Figure 9:
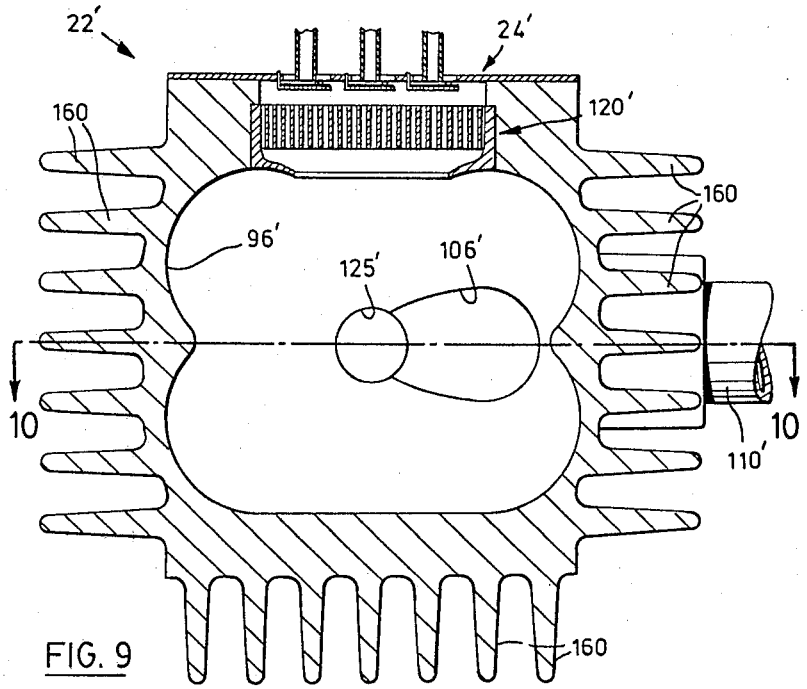
FIGS. 9 and 10 are views corresponding to FIGS. 2 and 3 respectively showing a modified combustion chamber.
Figure 10:
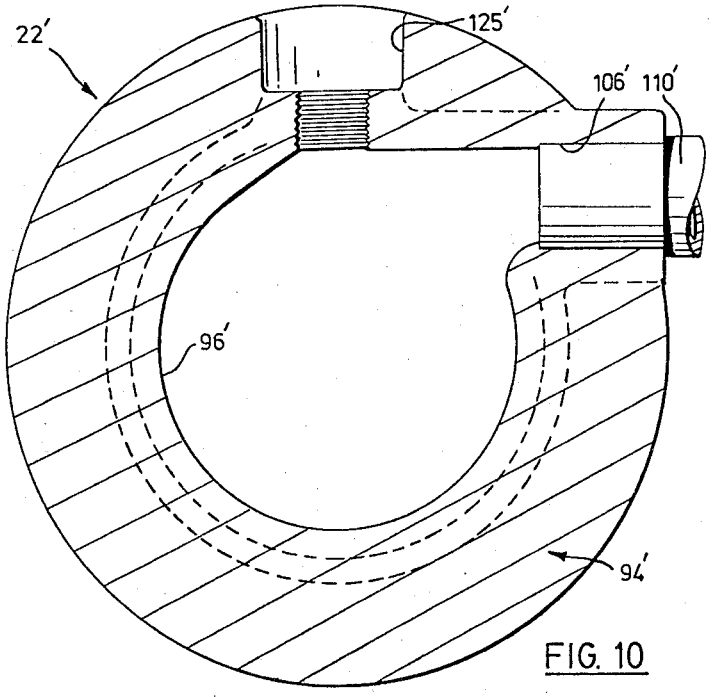

Reference will finally be made to FIGS. 9 and 10 which illustrate a modified form of combustion chamber which may be advantageous in certain applications. Primed reference numerals have been used in FIGS. 9 and 10 to illustrate parts which correspond with FIGS. 2 and 3. The combustion chamber shown in FIGS. 9 and 10 has, in fact, been designed primarily for use in a pulse combustion apparatus in which the combustion chamber is air cooled; that is, where the apparatus is either an air cooled engine or is being used for heating air. For this reason, the combustion chamber is shown as having external fins denoted 160 for promoting heat transfer from the combustion chamber to the surrounding air. However, it should be noted that this is only one example of an application of this form of combustion chamber and that, in other applications, the fins might well be omitted.

The primary difference between the combustion chamber of FIGS. 9 and 10 and that shown in the previous views is that the inner wall of the combustion chamber is contoured to define an inwardly protuberant surface portion around the inner periphery of the combustion chamber in its median plane 98'. The effect of this protuberant portion is to positively separate the returning combustion gases which enter the chamber cavity into two distinct flow paths. Thus, the flow pattern in the chamber of FIGS. 9 and 10 is essentially the same as that which occurs in the case of the combustion chamber of FIGS. 2 and 3, but is somewhat more discreet. This form of flow pattern may be desirable in some situations although it should be emphasized that, in practice, it has not generally been found essential to provide for physical separation of the returning gases in this fashion in order to achieve satisfactory combustion.

It should also be noted that the preceeding description relates to specific embodiments of the invention only and that many modifications are possible within the broad scope of the claims. For example, the specific materials referred to herein are not to be considered as essential, but rather as indicating materials which have been found satisfactory in practice. Also, it should be noted that the apparatus described has been designed primarily for burning gaseous fuels such as natural gas or propane although the principles of the invention are applicable to an apparatus for burning other fuels, for example, fuel oil or coal dust. For this reason, the term "fuel charge" has been used to denote any appropriate combustion medium and is intended to include a gas-air mixture. Of course, where different fuels are used, different expedients would undoubtedly be required for delivering the fuel charge to the combustion chamber. Fuel delivery may be effected in the manner disclosed in my U.S. Pat. aforesaid.

With reference to the valve means specifically disclosed in this application, it is to be understood that the number of valves will vary according to the size, of the apparatus. Seven valves have been found appropriate to a 100,000 B.t.u. unit, but a larger number would be required for a larger apparatus.

Also, while the preceeding description relates specifically to a heater, it is to be noted that the invention is not limited in this regard. For example, a pulse combustion apparatus of the form provided by the invention could be used as an engine for the recovery of mechanical or electrical energy.

With reference to the exhaust system of the apparatus, it should be noted that the primary exhaust pipe could be omitted in some applications and the heat exchange coils connected directly to the combustion chamber (without a manifold).

What I claim as my invention is:

1. A pulse combustion apparatus comprising:

a combustion chamber;

at least one exhaust pipe forming a resonant system with said chamber;

means for admitting successive fuel charges to said chamber; and, ignition means operable to initiate combustion in said chamber;

wherein the combustion chamber has an internal cavity which extends about a median plane, said cavity being of a shape which is circular in said plane and which curves generally inwardly from both sides of said plane around its entire periphery towards first and second ends of said cavity;

and wherein the combustion chamber further includes: an inlet at one of its said ends, through which successive fuel charges can enter said combustion chamber from said fuel charge admitting means in a direction generally normal to said median plane of the combustion chamber; and an exhaust gas outlet disposed in said median plane;

and wherein said exhaust pipe is coupled to said exhaust gas outlet and extends from the combustion chamber generally tangentially with respect to said cavity;

whereby combustion gases returning to said combustion chamber under the effect of a vacuum transient in the chamber at each cycle of the apparatus are caused to flow in a double toroidal flow pattern in said cavity and a subsequent fuel charge enters said flow generally centrally from said combustion chamber inlet

2. An apparatus as claimed in claim 1, wherein the combustion chamber cavity is of flattened, generally spherical shape with its maximum diameter disposed in said median plane.

3. An apparatus as claimed in claim 1, wherein said combustion chamber cavity is defined by a wall of said combustion chamber which includes a protuberant surface portion encircling said cavity in said median plane and arranged to positively separate combustion gases returning to said chamber into two discreet toroidal flow paths.

4. An apparatus as claimed in claim 1, wherein said exhaust pipe is of a length selected so that, in use, combustion of gases is at least substantially complete before the gases leave said pipe.

5. An apparatus as claimed in claim 4, wherein said exhaust pipe forms a primary pipe of an exhaust system further comprising: a manifold having an inlet to which the primary exhaust pipe is coupled, and a plurality of outlets spaced around the manifold; and a corresponding plurality of heat exchange coils each in the form of a hollow tube shaped to define a helix of substantially constant diameter extending about a longitudinal axis and having an inlet coupled to one of said manifold outlets, and an outlet; said coils being arranged around said manifold with their longitudinal axes generally parallel to one another.

6. A pulse combustion heater comprising:

a housing;

a combustion chamber within the housing having an internal cavity, and an inlet and an outlet communicating with said cavity;

means for admitting successive fuel charges to said cavity through said inlet;

ignition means operable to initiate combustion in said cavity; and an exhaust system including: a primary exhaust pipe having first and second ends and coupled to the combustion chamber outlet at its first end so as to extend generally tangentially from the combustion chamber cavity, said primary exhaust pipe being of a length selected so that combustion of gases is at least substantially complete before the gases leave said pipe; a manifold having an inlet to which the second end of the primary exhaust pipe is coupled, and a plurality of outlets spaced around the manifold; and a corresponding plurality of heat exchange coils each in the form of a hollow tube shaped to define a helix of substantially constant diameter extending about a longitudinal axis and having an inlet coupled to one of said manifold outlets, and an outlet; said coils being arranged around said manifold with their longitudinal axes generally parallel to one another;

a heat exchange chamber in said housing containing said heat exchange coils, the chamber having an inlet and an outlet for fluid to be heated; and, an exhaust chamber in the housing communicating with the outlets of said heat exchange coils and having an outlet for exhaust gases.

7. An apparatus as claimed in claim 6, wherein said heat exchange coils are arranged around said manifold in pairs with the turns of the respective coils in each pair in vertically staggered relationship and interleaved with one another so that the heat exchanger formed by said coils occupies minimum space.

8. An apparatus as claimed in claim 7 wherein the coils in each pair are formed as respective left and right hand windings of identical shape, and wherein the manifold outlets to which the coils are coupled are vertically staggered to provide for said interleaving of the turns of the respective coils.

9. An apparatus as claimed in claim 8 wherein the exhaust system includes first and second series of said coils, the coils in each said series being arranged in an annular configuration with the coils of said second series surrounding the coils of said first series and connected to said manifold by inwardly extended inlet end portions of the relevant coils.

10. An apparatus as claimed in claim 1, wherein said means for admitting fuel charges to the combustion chamber comprises a plurality of one-way valves disposed in said combustion chamber inlet and each including means defining at least one fuel inlet opening and a valve member responsive to pressure in said combustion chamber and movable to close said fuel inlet when combustion pressures exist in said chamber and to open said inlet during a vacuum transient for admitting fuel.

11. An apparatus as claimed in claim 10 wherein said means defining a fuel inlet comprises a valve plate extending across and closing said combustion chamber inlet except for said openings, and wherein each valve member is in the form of a light, pressure responsive disc disposed below said plate for movement between said open and closed positions, and wherein each disc is retained by a support member comprising a generally circular plate formed with openings through which pressurized gas in said combustion chamber can act on said disc, and a series of lugs spaced around said support plate and coupled to said valve plate so as to retain said disc.

12. An apparatus as claimed in claim 11, wherein the apparatus is designed to operate with a fuel charge comprising an air-gas mixture, and wherein the openings of each said one-way valve comprise a single central opening for gas, and a plurality of air openings disposed around said central opening, and wherein the admitting means further includes a plurality of gas inlet tubes each communicating with one of said central openings and with a gas supply, and wherein the air openings in said valve communicate with a combustion air supply.

13. An apparatus as claimed in claim 12, further comprising a gas cushion chamber connected to said gas supply and communicating with said gas inlet tubes, for providing a reservoir of gas for combustion.

14. An apparatus as claimed in claim 1, wherein the inside diameter of said combustion chamber cavity is equal to or less than three times the height of the cavity between said first and second ends.

15. An apparatus as claimed in claims 4 or 6, wherein said exhaust pipe is at least $\frac{3}{4}''$ in internal diameter and not less than 10 inches in length.

16. A pulse combustion apparatus comprising:

a combustion chamber having an inlet and an outlet;

means for admitting successive fuel charges to said chamber through said inlet;

ignition means operable to initiate combustion in said chamber; and an exhaust system including: a primary exhaust pipe which extends outwardly from said combustion chamber outlet; a manifold having an inlet to which the primary exhaust pipe is coupled, and a plurality of outlets spaced around the manifold; and a corresponding plurality of heat exchange coils each in the form of a hollow tube shaped to define a helix of substantially constant diameter extending about a longitudinal axis and having an inlet coupled to one of said manifold outlets, and an outlet; said coils being arranged adjacent one another with their longitudinal axes generally parallel to and spaced from one another.

17. An apparatus as claimed in claim 16, wherein the said coils are arranged in an annular configuration of alternating left and right hand windings of identical shape with the turns of each coil interleaved with the turns of adjacent coils.

* * * * *